US007178488B2

(12) United States Patent
Gramkow et al.

(10) Patent No.: US 7,178,488 B2
(45) Date of Patent: Feb. 20, 2007

(54) DEVICE COMPRISING AT LEAST ONE FUNCTIONAL UNIT OF A CAMSHAFT ADJUSTING DEVICE

(75) Inventors: Thomas Gramkow, Berlin (DE); Peter Schmidt, Berlin (DE)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 11/035,760

(22) Filed: Jan. 14, 2005

(65) Prior Publication Data

US 2005/0172921 A1 Aug. 11, 2005

Related U.S. Application Data

(63) Continuation-in-part of application No. PCT/EP03/05965, filed on Jun. 6, 2003.

(30) Foreign Application Priority Data

Jul. 15, 2002 (DE) ..... 102 31 917

(51) Int. Cl.
*F01L 1/00* (2006.01)

(52) U.S. Cl. ..... 123/90.1; 123/90.17; 123/90.38; 123/196 CP; 123/41.86

(58) Field of Classification Search ..... 123/90.1, 123/41.86, 90.38
See application file for complete search history.

(56) References Cited

U.S. PATENT DOCUMENTS

| | | | | |
|---|---|---|---|---|
| 4,607,601 | A | 8/1986 | Kohler | |
| 5,129,371 | A * | 7/1992 | Rosalik, Jr. | 123/90.38 |
| 6,308,672 | B1 | 10/2001 | Lichti et al. | |
| 6,435,154 | B1 | 8/2002 | Simpson et al. | |
| 6,591,796 | B1 * | 7/2003 | Scott | 123/90.13 |
| 6,837,207 | B2 * | 1/2005 | Bonde et al. | 123/195 HC |
| 6,860,010 | B2 * | 3/2005 | Jones et al. | 29/888.01 |

FOREIGN PATENT DOCUMENTS

| | | |
|---|---|---|
| DE | 197 56 018 | 6/1999 |

* cited by examiner

*Primary Examiner*—Thomas Denion
*Assistant Examiner*—Kyle M. Riddle
(74) *Attorney, Agent, or Firm*—Klaus J. Bach

(57) ABSTRACT

In an arrangement comprising at least one operating unit of a camshaft adjusting device for an internal combustion engine, the operating unit and at least one ventilation unit of a ventilation device are combined in an assembly module.

6 Claims, 2 Drawing Sheets

DEVICE COMPRISING AT LEAST ONE FUNCTIONAL UNIT OF A CAMSHAFT ADJUSTING DEVICE

This is a Continuation-In-Part Application of International Application PCT/EP03/05965 filed Jun. 6, 2003 and claiming the priority of German application 102 31 917.0 filed Jul. 15, 2002.

BACKGROUND OF THE INVENTION

The invention relates to a device comprising at least one operational unit of a camshaft adjusting device of an internal combustion engine.

In order to change the position of a camshaft relative to a crankshaft or relative to another camshaft in order to achieve a phase displacement between the shafts, it is known to provide camshaft adjusting devices on internal combustion engines. Camshaft adjusting devices generally comprise two sensors arranged in a housing in order to detect the position of the camshaft or camshafts and of the crankshaft, and an actuator arranged in the housing, in order to adjust the angular position of the camshaft or camshafts relative to the crankshaft.

It is furthermore known to provide a crankcase ventilation device, wherein the camshaft adjusting device and the crankcase ventilation device are separate units. The crankcase ventilation device generally comprises an oil separator, which is arranged in a separate housing, for cleaning crankcase ventilation gases. In order to avoid high emissions from the crankcase ventilation device, crankcase ventilation gases are subjected to a combustion process of the internal combustion engine. Before being returned to the engine intake, the crankcase ventilation gases, which are contaminated with oil, are cleaned by means of the oil separator.

It is the object of the invention to provide a device by which space requirements and of costs of an internal combustion engine are reduced.

SUMMARY OF THE INVENTION

In an arrangement comprising at least one operating component of a camshaft adjusting device for an internal combustion engine, the operating component and at least one ventilation unit of a ventilation device are combined in an assembly module.

In this way, additional components, construction space, weight and outlay on installation and costs can be saved, since the operational unit is at least partially formed integrally with the ventilation unit or vice versa.

In this context, the ventilation unit is to be understood as comprising all of the units which seem to the expert to be expedient and belong directly or indirectly to a ventilation device, such as, in particular, electric and/or mechanical oil separators and other filter units and intake passages, exhaust passages etc. Furthermore, the term assembly module is to be understood as meaning a unit which can be mounted as a single complete structure.

If the operating unit is designed as a housing of the camshaft adjusting device and if the latter at least partially, or advantageously completely, forms a housing for the ventilation device, certain housing parts can advantageously be omitted and, as a result, construction space and weight can be saved.

If the ventilation unit forms at least part of an oil separator, it is possible, in particular, to avoid a complicated, additional mounting of the oil separator and, in addition, it is possible to achieve a particularly space-saving integration of the oil separator, specifically, in a common housing together with the camshaft adjusting device.

In addition, components can be saved and the costs reduced if a fastening element of the camshaft adjusting device also forms a shielding element of the ventilation unit and/or at least part of the oil separator is formed integrally with the operating unit, which comprises a housing. In particular, it is advantageous to incorporate a labyrinth means of the oil separator into the housing of the camshaft adjusting device.

Furthermore, components, specifically, fastening means, can be saved by the fastening element being attached by means of a cohesive material joint. In this case, any of the cohesive material joints appearing to an expert to be expedient are conceivable, such as bonding, welding, soldering, etc. However, the fastening element is particularly advantageously fastened by means of a welding process, specifically, by means of a laser welding process or by means of an ultrasonic welding process, thus resulting in a particularly cost-effective mounting of the assembly module. In principle, however, frictional and/or form-fitting fastenings arrangements are also conceivable.

The invention will become more readily apparent from the following description of an exemplary embodiment described below with reference to the accompanying drawings.

DESCRIPTION OF A PARTICULAR EMBODIMENT

Figure 1:
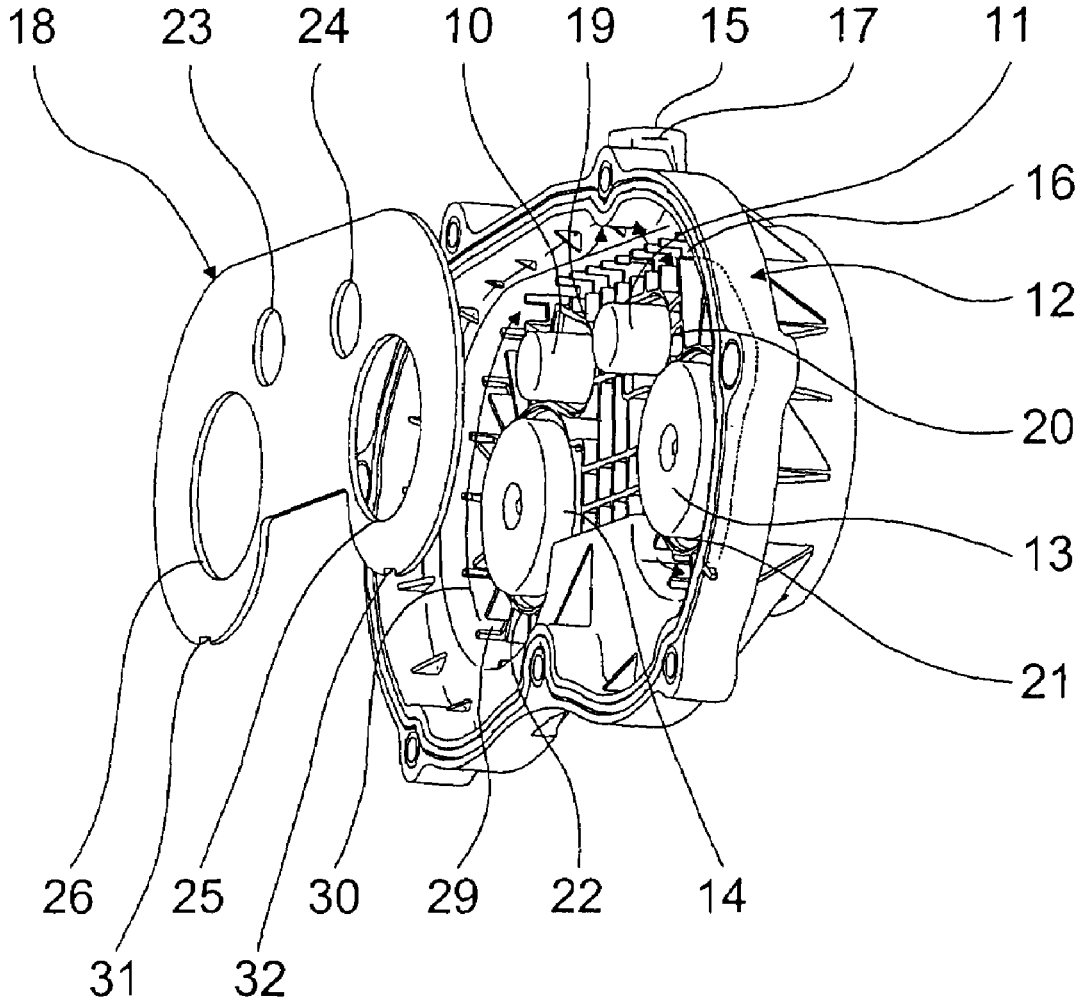
FIG. 1 shows in a perspective view a device according to the invention before the installation therein of a fastening plate.

FIG. 1 shows a device comprising essentially five functional units 10, 11, 12, 13, 14 of a camshaft adjusting device for an internal combustion engine of a motor vehicle, wherein the functional components 10 and 11 are sensors, the functional components 13, 14 are actuators and the functional component 12 is a housing in which the functional units 10, 11, 13, and 14 are arranged.

According to the invention, the five functional units 10, 11, 12, 13, 14 and essentially three ventilation units 15, 16, 17 of a crankcase ventilation device are designed in the form of an assembly module and can be fitted as a single unit on the internal combustion engine. In this case, the ventilation unit 15 is an output passage, the ventilation unit 16 is a labyrinth means of an oil separator and the ventilation unit 17 is a pressure-regulating valve which is disposed in the output passage 15.

The functional unit 12 of the camshaft adjusting device, that is, the housing, also forms a housing for the crankcase ventilation device or the oil separator, with the output passage and the labyrinth means being molded integrally into the housing.

During assembly of the assembly module, the actuators and the sensors are inserted into corresponding recesses 19, 20, 21, 22 of the cup-shaped housing. A filter insert (not illustrated specifically) is subsequently placed onto the labyrinth means, which is formed by ribs arranged essentially in the radially outer region surrounding the recesses 19, 20, 21, 22. Finally, a fastening plate 18 is inserted into the housing, which plate extends over the entire region of the actuators and sensors and rests on the labyrinth means. The fastening plate 18 fixes the sensors and the actuators via rings (not illustrated specifically), which are fastened to the actuators and sensors, in the recesses 19, 20, 21, 22, the actuators and the sensors protruding through openings 23, 24, 25, 26 in the fastening plate 18. The fastening plate 18, which also forms a shield for the filter insert, the labyrinth means and the pressure valve, is connected to the housing or to the functional unit 12 by a cohesive material joint by means of an ultrasonic welding process. In principle, however, it would also be conceivable for the sensors and the actuators to be fastened individually in the housing. The control fastening plate 18, however, makes it possible to save additional components and reduces the outlay on mounting of the various components.

Figure 2:
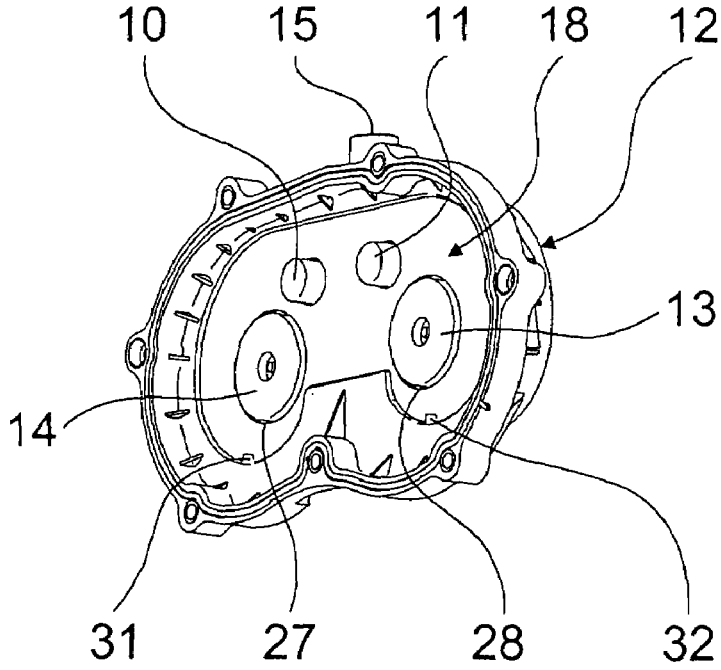
FIG. 2 shows the device from FIG. 1 after the installation of the fastening plate.
Figure 3:
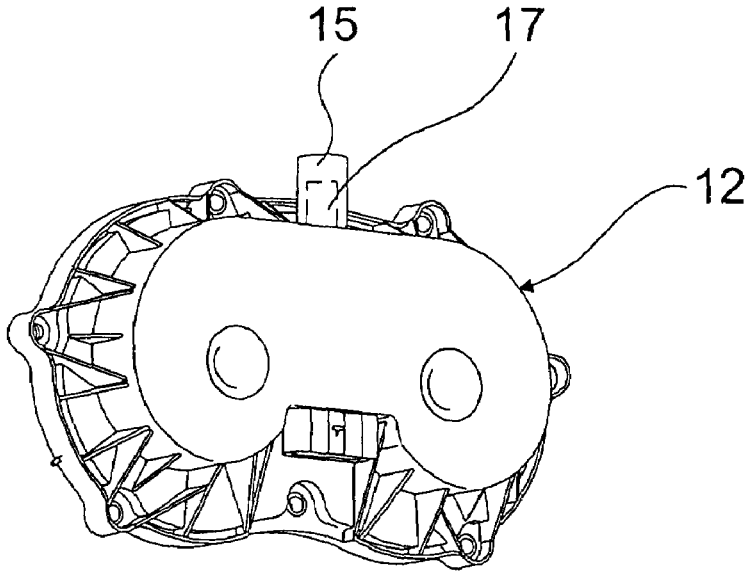
FIG. 3 is a prospective view of the outside of the device.

After the assembly and the mounting of the assembly module on the internal combustion engine, during operation crankcase ventilation gases 30 are sucked off centrally via the ventilation unit 15 which is an output passage and is arranged in the upper region (FIGS. 1 and 2). In this case, the crankcase ventilation gases 30 in the lower region are sucked upward through gaps 27, 28 between the actuators and the fastening plate 18 and through a groove 29 in the labyrinth means to the outlet passage. The crankcase ventilation gases 30 are then fed to a combustion process of the internal combustion engine.

Oil separated from the crankcase ventilation gases by means of the oil separator is collected in the lower region, below the actuators, and can flow back into the crankcase through passages 31, 32 in the fastening plate 18.

What is claimed is:

1. An arrangement comprising a housing (12) including a camshaft adjusting device for mounting on an internal combustion engine of a motor vehicle including an engine ventilation device with ventilation structures (25, 16, 17) combined in an assembly module of the housing (12) of the camshaft adjusting device for venting the internal combustion engine via the camshaft adjusting device housing (12).

2. The arrangement as claimed in claim 1, wherein the ventilation unit (16) forms at least a part of an oil separator.

3. The arrangement as claimed in claim 1, wherein at least part of an oil separator is formed integrally with the housing (12) of the camshaft adjusting device.

4. The arrangement as claimed in claim 3, wherein the oil separator includes a labyrinth structure (16), which is molded onto the housing (12).

5. The arrangement as claimed in claim 1, wherein a fastening element (18) of the camshaft adjusting device additionally forms a shield of the ventilation unit (15, 16, 17).

6. The arrangement as claimed in claim 5, wherein the fastening element (18) is fastened by means of a cohesive material joint.

* * * * *